US011754977B2

(12) United States Patent
Meerovitsch

(10) Patent No.: US 11,754,977 B2
(45) Date of Patent: Sep. 12, 2023

(54) TIMEPIECE WITH REVERSIBLE WATCH CASE

(71) Applicant: Nove Limited, Kwai Chung (HK)

(72) Inventor: Alexander Meerovitsch, Kwai Chung (HK)

(73) Assignee: Nove Limited, Kwai Chung (HK)

( * ) Notice: Subject to any disclaimer, the term of this patent is extended or adjusted under 35 U.S.C. 154(b) by 315 days.

(21) Appl. No.: 17/168,415

(22) Filed: Feb. 5, 2021

(65) Prior Publication Data

US 2022/0206439 A1 Jun. 30, 2022

(30) Foreign Application Priority Data

Dec. 29, 2020 (HK) ..... 32020022874.2

(51) Int. Cl.
*G04B 37/04* (2006.01)
*G04B 37/12* (2006.01)

(52) U.S. Cl.
CPC ..... *G04B 37/0472* (2013.01); *G04B 37/12* (2013.01)

(58) Field of Classification Search
CPC ..... B64U 2101/30
See application file for complete search history.

(56) References Cited

U.S. PATENT DOCUMENTS

| | | | |
|---|---|---|---|
| 2006/0018202 | A1 | 1/2006 | Girardin et al. |
| 2006/0034161 | A1 | 2/2006 | Muller |
| 2019/0155222 | A1 | 5/2019 | Kim |

FOREIGN PATENT DOCUMENTS

| | | |
|---|---|---|
| CN | 1768309 | 5/2006 |
| CN | 201812144 | 4/2011 |
| CN | 204389893 | 6/2015 |
| DE | 9408566 | 11/1994 |
| JP | 07280956 | 4/2003 |
| JP | 2007303843 | 6/2009 |
| KR | 20160090008 | 7/2016 |
| WO | 2005043259 | 5/2005 |

OTHER PUBLICATIONS

European Search Report for Application No. 2155384.7-1001 dated Jul. 8, 2021.

*Primary Examiner* — Renee S Luebke
*Assistant Examiner* — Matthew Hwang
(74) *Attorney, Agent, or Firm* — RENNER KENNER GREIVE BOBAK TAYLOR & WEBER

(57) ABSTRACT

A timepiece includes a base, a case, a frame, and a gimbal coupling mechanism. The case holds a time display. The case is pivotably connected to the frame for rotation about a first axis. The frame is pivotably connected to the base for rotation about a second axis between an extended and a retracted position. The frame form a two-axis gimbal supporting the case. The gimbal coupling mechanism operably couples the frame and the case whereby rotation of the frame from the retracted position to the extended position then back to the retracted position rotates the case about the first axis to facilitate flipping of the case so as to selectively hide or show the time display.

14 Claims, 6 Drawing Sheets

TIMEPIECE WITH REVERSIBLE WATCH CASE

TECHNICAL FIELD

The invention relates to a timepiece with a reversible watch case.

BACKGROUND

Watches can be provided with watch cases that are reversible and so can be viewed from both sides. This allows, for instance, that a time display can be turned inward as to provide protection when it may otherwise be at risk of being damaged.

US2007/0274163A discloses a timepiece with a frame rotatably coupled with a support and a watch case reversibly mounted in the frame. The watch case can adopt a first position in which the dial of the watch case is visible and a second position in which the back cover or another dial of the watch case is visible. In use, a user first rotates both the frame and the watch case relative to a support until the frame and the watch case are form a sufficiently large angle with support. The user then turns the watch case around itself within the frame by 180 degrees, and afterwards, rotates and holds the frame and the watch case back over the support. With this design, the user has to perform multiple coordinated actions, in different directions and/or at different angles, in order to properly turn over the watch case and/or to properly stop the watch case at the desired position, which can be inconvenient or difficult to control at times.

SUMMARY

In a first aspect, there is provided a timepiece comprising a base, a frame, a watch case, and a coupling mechanism. The frame is pivotably coupled to the base and pivotable relative to the base about a pivot axis between a retracted position and an extended position. The watch case includes a first face and a second face opposite the first face. At least one of the first face and the second face includes a time display. The watch case is rotatably mounted within the frame and rotatable relative to the frame about a rotation axis. The watch case is configurable to be in a first configuration, in which one of the first face or the second face is visible when the frame is in the retracted position, and a second configuration, in which the other one of the first face or the second face is visible when the frame is in the retracted position. The coupling mechanism operably couples the frame with the watch case to control rotation of the watch case based on pivoting movement of the frame relative to the base so as to facilitate the watch case to change from one of the first configuration and the second configuration to the other of the first configuration and the second configuration when the frame is pivoted from the retracted position to the extended position and subsequently back to the retracted position.

The frame may essentially form or provide a two-axis gimbal, the two axes of which are at an angle (e.g., mutually perpendicular).

In one embodiment, the coupling mechanism is configured to rotate the watch case relative to the frame such that the watch case changes from one of the first configuration and the second configuration to the other of the first configuration and the second configuration when the frame is pivoted from the retracted position to the extended position and subsequently back to the retracted position.

The coupling mechanism may be configured such that the watch case begins to rotate relative to the frame substantially simultaneously as the frame begins to pivot relative to the base from the retracted position. Alternatively, the coupling mechanism may be configured such that the watch case begins to rotate relative to the frame after the frame has begun to pivot relative to the base from the retracted position (i.e., after the frame has moved away from the retracted position). The coupling mechanism may be configured such that the rotation of the watch case relative to the frame ends substantially simultaneously as the frame pivots relative to the base back to the retracted position. Alternatively, the coupling mechanism may be configured such that the rotation of the watch case relative to the frame ends before the frame has pivoted relative to the base back to the retracted position (i.e., before the frame has moved back to the retracted position; e.g., when the frame has moved to the extended position).

The frame may be pivotable relative to the base about the pivot axis from the retracted position to the extended position (or vice versa) by an angle. The angle may be larger than 90 degrees, e.g., between 90 degrees to 180 degrees, or between 90 degrees to 135 degrees.

The pivoting of the frame from an initial retracted position (watch face at one of the first and second configurations) to the extended position and subsequently back to the retracted position (watch face at the other one of the first and second configurations) defines a pivoting cycle. The coupling mechanism may rotate the watch case relative to the frame by any angles, e.g., about 180 degrees, less than 180 degrees, or more than 180 degrees and during at least part of the pivoting cycle (i.e., the rotation need not last the entire pivoting cycle), continuously or intermittently.

The base, the frame, and/or the watch case are sized and shaped and/or the coupling mechanism are configured such that the watch case can be turned over (to change between first and second configurations) without being blocked by other components of the timepiece.

The watch case may be configured to rotate about the rotation axis for about 180 degrees to change from the first configuration to the second configuration and/or may be configured to rotate about the rotation axis for about 180 degrees to change from the second configuration to the first configuration. The watch case may resume other configurations other than the first and second configurations.

The watch case may be a casing that holds one or more of: dials, movements, crowns, display, electronics, etc., depending on the type of timepiece. Or the watch case may be a casing that holds or contains such a casing.

The watch case may be removably coupled to the frame.

The pivot axis may be defined by a hinge. The coupling mechanism may be arranged at the hinge. The hinge may further include components such as bearings, washings, gears, support shaft, position limiting elements, etc.

In one embodiment, the coupling mechanism is arranged to enable or cause rotation of the watch case relative to the frame when the frame pivots from the retracted position to the extended position (and optionally to prevent rotation of the watch case relative to the frame when the frame pivots from the extended position to the retracted position). In an alternative embodiment, the coupling mechanism is arranged to enable or cause rotation of the watch case relative to the frame when the frame pivots from the extended position to the retracted position (and optionally to prevent rotation of the watch case relative to the frame when the frame pivots from the retracted position to the extended position). In other embodiments, the coupling mechanism is arranged to selectively enable/cause rotation of the watch case relative to the frame during at least part of the pivoting cycle.

In one embodiment, the coupling mechanism is arranged to enable or cause rotation of the watch case about the rotation axis in a first rotation direction and to prevent rotation of the watch case about the rotation axis in a second rotation direction opposite to the first rotation direction.

In one embodiment, the coupling mechanism comprises a gear mechanism and a one-way clutch operably coupled with the gear mechanism.

In one embodiment, the gear mechanism comprises: a first gear operably coupled to the watch case and arranged to rotate with the watch case; and a second gear operably coupled to the frame and the first gear. The one-way clutch may be operably coupled with the second gear to permit rotation of the second gear in only one rotation direction.

The first gear may be fixedly coupled to the watch case to rotate about the rotation axis. The first and second gears may engage or mesh with each other. The first and second gears may be meshed tooth wheels (e.g., bevel gears), plain friction wheels, etc. The first gear may rotate about an axis (e.g., the rotation axis); the second gear may rotate about another axis (e.g., the pivot axis) substantially orthogonal to the axis of the first gear.

In one embodiment, the one-way clutch comprises a one-way roller clutch, pawl and ratchet clutch, sprag clutch, or the like. The one-way clutch may be mounted co-axially with the second gear.

In one embodiment, the rotation axis is substantially orthogonal to the pivot axis.

In one embodiment, the timepiece further comprises an actuation mechanism operably coupled with the frame for pivoting the frame to operate the coupling mechanism.

In one embodiment, the actuation mechanism comprises: an actuator; and a drive mechanism arranged to drivingly couple the actuator with the frame.

In one embodiment, the actuator is movable between a first position that corresponds to the retracted position of the frame and a second position that corresponds to the extended position of the frame. The actuator may include a knob, pin, switch, lever, handle, arm, tab, etc. that can rotate, translate, flip, etc. The actuator facilitates switching of the watch case between the first configuration and the second configuration.

The actuator may be rotatably mounted to the base and is rotatable about an actuator rotation axis between the first position and the second position. The actuator rotation axis may be substantially orthogonal to the pivot axis. The actuator rotation axis may be substantially orthogonal to the pivot axis and the rotation axis when the frame is at the retracted position. The actuator may be mounted to the base adjacent the hinge that defines the pivot axis.

The actuator may be rotatable about the actuator rotation axis from the first position to the second position by an angle. The angle may be larger than 90 degrees, e.g., between 90 degrees to 180 degrees, or between 90 degrees to 135 degrees. This angle need not be the same as the angle the frame pivots relative to the base about the pivot axis from the retracted position to the extended position.

In one embodiment, the actuator comprises a lever shaped to generally follow a contour of the base. In one embodiment, the lever abuts the base when the lever is at the first position that corresponds to the retracted position of the frame.

In one embodiment, the timepiece further comprises securing means for securing the frame to the base when the frame is in the retracted position. The securing means may comprise a lock, a latch, etc. In one embodiment, the securing means comprises frictional engagement means arranged between the frame and the base. The frictional engagement means may be provided by the frame and/or the base. The frictional engagement means may include a frictional (e.g., roughened) surface, nubs and dimples, projections, etc.

In one embodiment, the timepiece further comprises securing means for securing the watch case to the frame when the watch case is in the first and second configurations. The securing means may comprise a lock, a latch, etc. In one embodiment, the securing means comprises frictional engagement means arranged between the frame and the base. The frictional engagement means may be provided by the frame and/or the base. The frictional engagement means may include a frictional (e.g., roughened) surface, nubs and dimples, projections, etc.

In one embodiment, the first face comprises a first watch face and the second face comprises a second watch face different from the first watch face. The first and second watch faces may be arranged to display different time (e.g., of different time zones). The first and second watch faces may be arranged to display the same time in different ways (e.g., different patterns, different dials, etc.).

In one embodiment, only one of the first face and the second face comprises a watch face.

In one embodiment, the first face and/or the second face may include a plain surface, a protective surface/cover, a surface engraved/printed/stamped with words/pictures, a mirror, a compass, a map, a calendar, a stopwatch, a solar panel, or any other means arranged to perform a non-time-display function.

In one embodiment, the watch case is water resistant.

The timepiece may further include one or more attachment members arranged on the base and/or the frame for coupling with a bracelet, a band, a wire, a string, etc.

In one embodiment, the timepiece is portable or wearable. The timepiece may be a clock or a watch (e.g., a chronograph). The timepiece may be a wrist watch, a pocket watch, etc. The timepiece may be a mechanical watch (with clockwork mechanism(s)), an electric watch, a quartz watch, etc.

In a second aspect, there is provided a method for operating the timepiece of the first aspect. The method includes pivoting the frame relative to the base about the pivot axis to rotate the watch case. This may include pivoting the frame relative to the base about the pivot axis from the retracted position to the extended position and then back to the retracted position to change the watch case from the first configuration to the second configuration; and/or pivoting the frame relative to the base about the pivot axis from the retracted position to the extended position and then back to the retracted position to change the watch case from the second configuration to the first configuration.

In a third aspect, there is provided a timepiece accessory, comprising a base, a frame, and a coupling mechanism. The frame is pivotably coupled to the base and pivotable relative to the base about a pivot axis between a retracted position and an extended position. The frame is arranged to be rotatably coupled with a watch case that includes a first face and a second face opposite the first face. The watch case, when coupled to the frame, is rotatably mounted within the frame and rotatable relative to the frame about a rotation axis. The watch case is configurable to be in a first configuration, in which one of the first face or the second face is visible when the frame is in the retracted position, and a second configuration, in which the other one of the first face or the second face is visible when the frame is in the retracted position. The coupling mechanism operably couples the frame and the watch case (when the watch case is mounted to the frame) to control rotation of the watch case based on pivoting movement of the frame relative to the base so as to facilitate the watch case to change from one of the first configuration and the second configuration to the other of the first configuration and the second configuration when the frame is pivoted from the retracted position to the extended position and subsequently back to the retracted position. In this way, in one example, when the frame is pivoted from the retracted position to the extended position and subsequently back to the retracted position, the watch case may be rotated from one of the first configuration and the second configuration to the other of the first configuration and the second configuration.

The timepiece of the first aspect can be adapted for other applications. Thus, in a fourth aspect, there is provided an article comprising a base, a frame, a core, and a coupling mechanism. The frame is pivotably coupled to the base and pivotable relative to the base about a pivot axis between a retracted position and an extended position. The core includes a first face and a second face opposite the first face. The core is rotatably mounted within the frame and rotatable relative to the frame about a rotation axis. The core is configurable to be in a first configuration, in which one of the first face or the second face is visible when the frame is in the retracted position, and a second configuration, in which the other one of the first face or the second face is visible when the frame is in the retracted position. The coupling mechanism is operably couples the frame with the core to control rotation of the core based on pivoting movement of the frame relative to the base so as to facilitate the core to change from one of the first configuration and the second configuration to the other of the first configuration and the second configuration when the frame is pivoted from the retracted position to the extended position and subsequently back to the retracted position. For example, when the frame is pivoted from the retracted position to the extended position and subsequently back to the retracted position, the core is rotated from one of the first configuration and the second configuration to another one of the first configuration and the second configuration. For example, the core may include or may be a decorative object (e.g., a gemstone), a photo-frame or photo-mount, etc. Other features of the timepiece of the first aspect can be applied to the article of the fourth aspect, as appropriate and applicable. For example, features applicable to the watch case in the timepiece of the first aspect may be applicable to the core in the article of the fourth aspect.

In a fifth aspect, there is provided a timepiece comprising a base, a case, a frame, and a gimbal coupling mechanism. The case holds a time display. The case is pivotably connected to the frame for rotation about a first axis. The frame is pivotably connected to the base for rotation about a second axis between an extended and a retracted position. The frame form a two-axis gimbal supporting the case. The gimbal coupling mechanism operably couples the frame and the case whereby rotation of the frame from the retracted position to the extended position then back to the retracted position rotates the case about the first axis to facilitate flipping of the case so as to selectively hide or show the time display.

In one embodiment the gimbal coupling mechanism operably couples the frame and the case such that rotation of the frame from the retracted position to the extended position then back to the retracted position rotates the case about the first axis for about 135 degrees to 225 degrees, for about 160 degrees to 200 degrees, for about 170 degrees to 190 degrees, or for about 180 degrees.

In one embodiment the gimbal coupling mechanism operably couples the frame and the case whereby rotation of the frame toward the extended position rotates the case about the first axis, and rotation of the frame toward the retracted position prevents rotation of the case about the first axis. In one implementation, the gimbal coupling mechanism comprises: a gimbal gear pair comprising a first gear mounted to the case and a second gear mounted to the base or the frame, and a one-way clutch having a rotary output member fixed to the first gear or the second gear for unidirectional rotation.

In one embodiment the time display includes at least one movement selected from a clockwork movement and an electro-mechanical movement. In one embodiment the time display may include at least one digital display.

In one embodiment the first and second gears comprise meshed toothed wheels (e.g., bevel gears). In another embodiment the first and second gears comprise plain friction wheels.

In one embodiment the first and second axes of the two-axis gimbal are mutually perpendicular.

In one embodiment the first gear is rotationally fast with the case and rotates about the first axis and the second gear is mounted for rotation about the second axis.

In one embodiment the rotary output member surrounds a coaxial rotary input member and is fixed at least partially within the second gear. In one embodiment the rotary output member is surrounded by a coaxial rotary input member.

In one embodiment the one-way clutch is a one-way roller clutch. In other embodiments the one-way clutch may be a pawl and ratchet clutch, a sprag clutch, etc.

In one embodiment the timepiece further comprises an actuator coupled to the base to rotate the frame between the extended and retracted positions. The actuator may be manually operated or may be motorized. The actuator may include a lever, a winder such as a rotary knob or a handle, etc.

In one embodiment the lever rotates an actuator gear pair comprising a first actuator gear connected to the lever to turn about a fulcrum axis and a second actuator gear rotationally fast with the frame and mounted to rotate about the second axis.

In one embodiment the first and second actuator gears comprise meshed toothed wheels (e.g., bevel gears). In another embodiment the first and second actuator gears comprise plain friction wheels.

In one embodiment, the fulcrum axis is substantially orthogonal to each of the first and second axes when the frame is at the retracted position.

In one embodiment the lever and base comprise cooperating detent features for holding the lever in a closed position and the frame in the retracted position. In one embodiment the lever extends alongside an edge of the base in the closed position.

In one embodiment, the timepiece is portable or wearable. The timepiece may be a clock or a watch (e.g., a chronograph). The timepiece may be a wrist watch, a pocket watch, etc. The timepiece may be a mechanical watch (with clockwork mechanism(s)), an electric watch, a quartz watch, etc.

In one embodiment, the case includes two time displays, one on each face of the case.

Other features and aspects of the invention will become apparent by consideration of the detailed description and accompanying drawings. Any feature(s) described herein in relation to one aspect or embodiment may be combined with any other feature(s) described herein in relation to any other aspect or embodiment as appropriate and applicable.

BRIEF DESCRIPTION OF THE DRAWINGS

Embodiments of the invention will now be described, by way of example, with reference to the accompanying drawings in which.

DETAILED DESCRIPTION

FIGS. 1 to 5 show a timepiece in the form of a watch 10 in one embodiment of the invention. The watch 10 generally includes a base 12, a frame 14 pivotably coupled to the base 12, and a watch case 16 rotatably coupled to the frame 14. The frame 14 generally forms a two axis gimbal. The watch 10 also includes a gimbal coupling mechanism operably coupling the frame 14 and the watch case 16 to control rotation of the watch case 16 based on pivoting movement of the frame 14 relative to the base 12.

Figure 1:
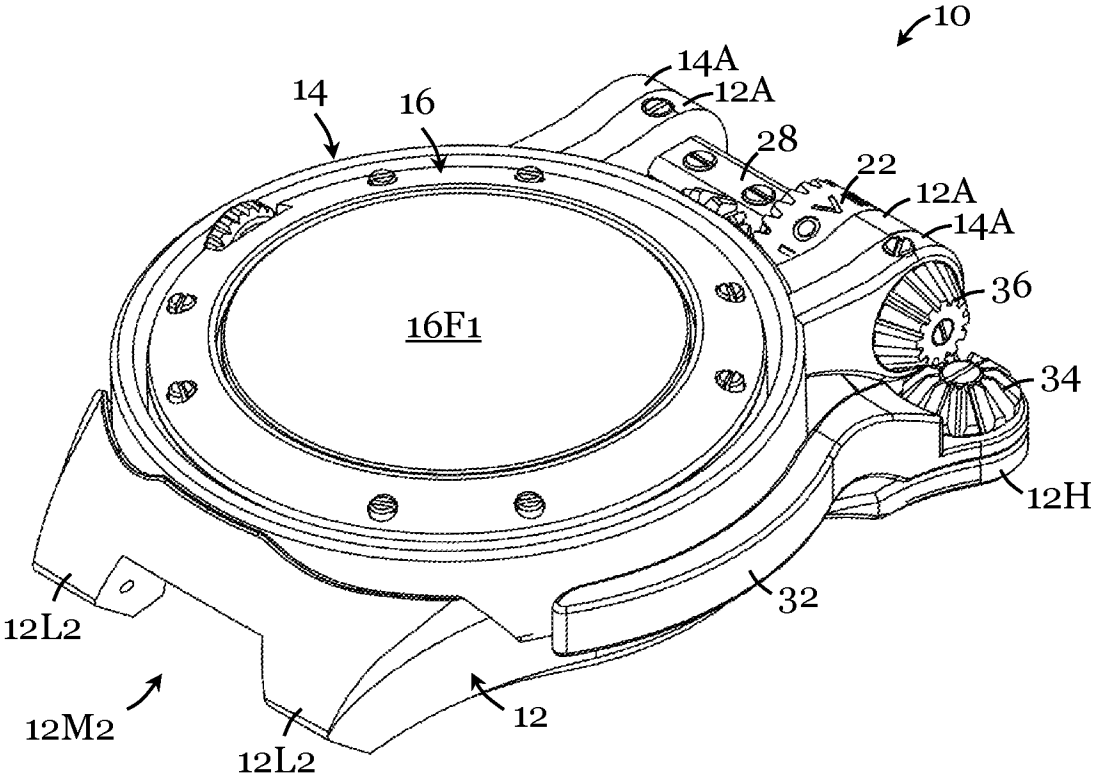
FIG. 1 is a perspective view of a watch in one embodiment of the invention.
Figure 2:
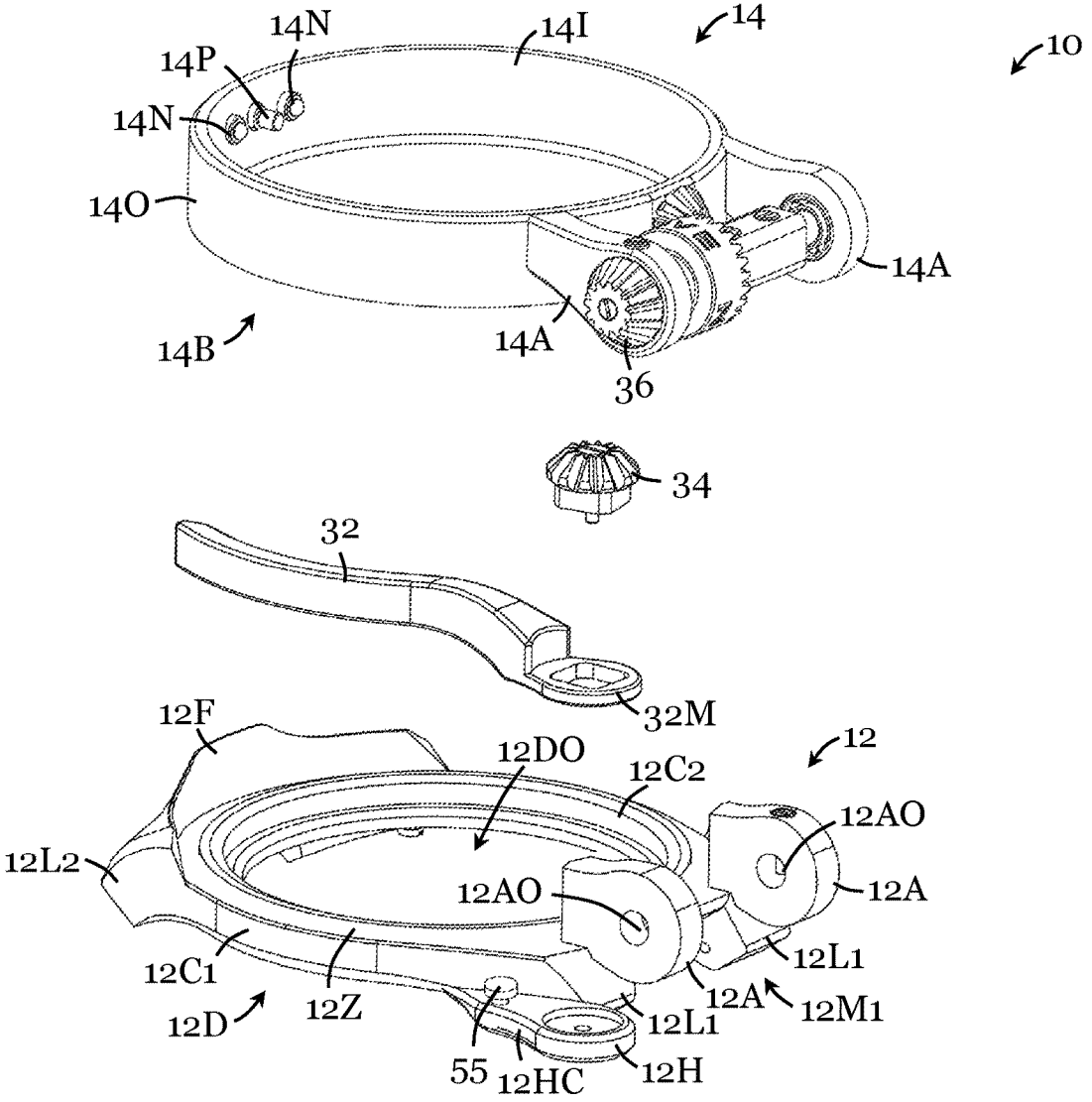
FIG. 2 is a part-exploded view illustrating the actuation mechanism of the watch of FIG. 1.
Figure 5:
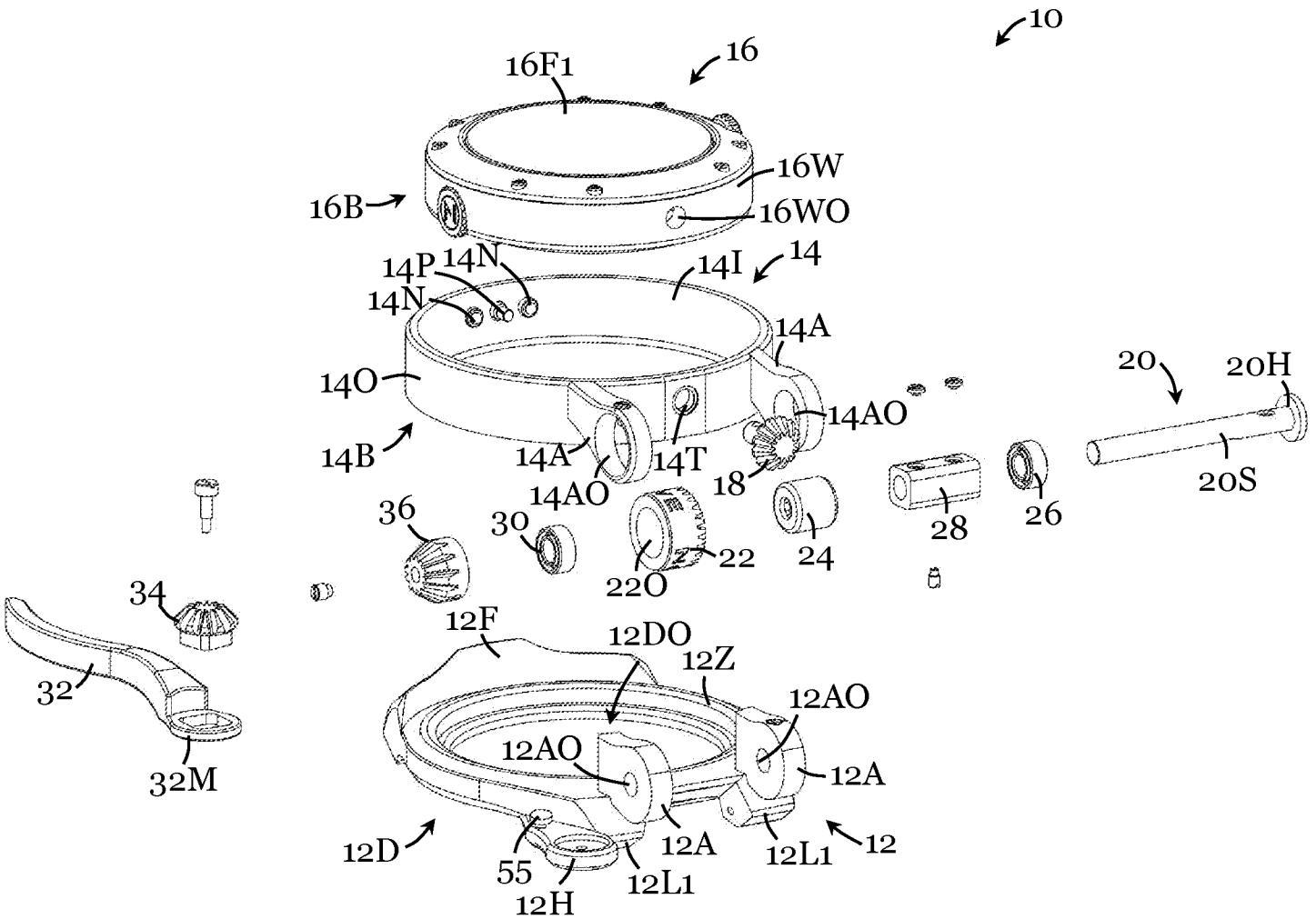
FIG. 5 is an exploded view of the watch of FIG. 1.

Referring to FIGS. 1, 2, and 5, the base 12 includes a deck 12D defining a generally circular opening 12DO through which at least part of a backside of the watch case 16 is accessible. The deck 12D includes a face 12Z upon which the frame 14 can rest and defines an opening that can receive at least part of the watch case 16. The deck 12D includes legs 12L1, 12L2 arranged at opposite ends of the deck 12D to define watch bracelet/band attachment members 12M1, 12M2 for attaching a watch bracelet or watch band, curved sides 12C1, 12C2 extending between the opposite ends of the deck 12D, and a flange 12F adjacent the watch bracelet/band attachment 12M2. Optionally, a radially inner surface of the flange 12F may frictionally engage a radially outer surface 14O of the frame 14. The base 12 also includes a lever mount 12H arranged adjacent the leg 12L1 (not between the legs 12L1, 12L2) for mounting a lever that can be actuated to pivot the frame 14 and rotate the watch case 16, and a handling coupling portion 12HC arranged between the deck 12D and the lever mount 12H to couple the deck 12D to the lever mount 12H. The coupling portion 12HC defines a generally flat platform on which a pin 55 is arranged. The pin 55 extends generally perpendicularly from the platform. The pin 55 includes an enlarged head portion and a stem portion between the platform and the head portion. A pair of plate-like arms 12A are arranged on the face 12Z at one end and are disposed adjacent the watch bracelet/band attachment 12M1. The arms 12A are generally perpendicular to the face 12Z and are extending generally parallel to each other in a direction away from the opening 12DO. The arms 12A include aligned openings 12AO configured to receive or support components of the watch 10.

Referring to FIGS. 1, 3, 4, and 5, the frame 14 is pivotable relative to the base 12 about a pivot axis X. The frame 14 can pivot between a retracted position (FIG. 1) and an extended position in which the frame 14 is fully pivoted away from the base 12. The frame 14 includes a generally ring-shaped body 14B having a radially inner surface 14I and a radially outer surface 14O. A pin 14P for supporting rotation of the watch case 16 and two nubs 14N (one on each side of the pin 14P) for engaging with the watch case 16 are arranged on the radially inner surface of the body 14B, at the end of the deck 12D at which the watch bracelet/band attachment 12M2 is arranged. A through-hole 14T is formed on the body 14B, at a position diametrically opposite the pin 14P and nubs 14N of the frame 14. The through-hole 14T is arranged to receive a shaft of a gear means. A pair of plate-like arms 14A are coupled to the body 14B at the end of the deck 12D at which the watch bracelet/band attachment 12M1 is arranged. The arms 14A are generally parallel and are arranged to extend away from the body 14B. The through-hole 14T is arranged between the arms 14A. Each of the arms 14A include an opening 14AO at an open end. The two openings 14AO are aligned but are sized differently (the opening 14AO adjacent the lever mount 12H is bigger). The openings 14AO are arranged to receive or support components of the watch 10, as explained in greater detail below. The arms 14A define a space there-between. The arms 12A of the base 12 and a coupling mechanism coupling the frame 14 and the watch case 16 are arranged in this space.

Figure 3:
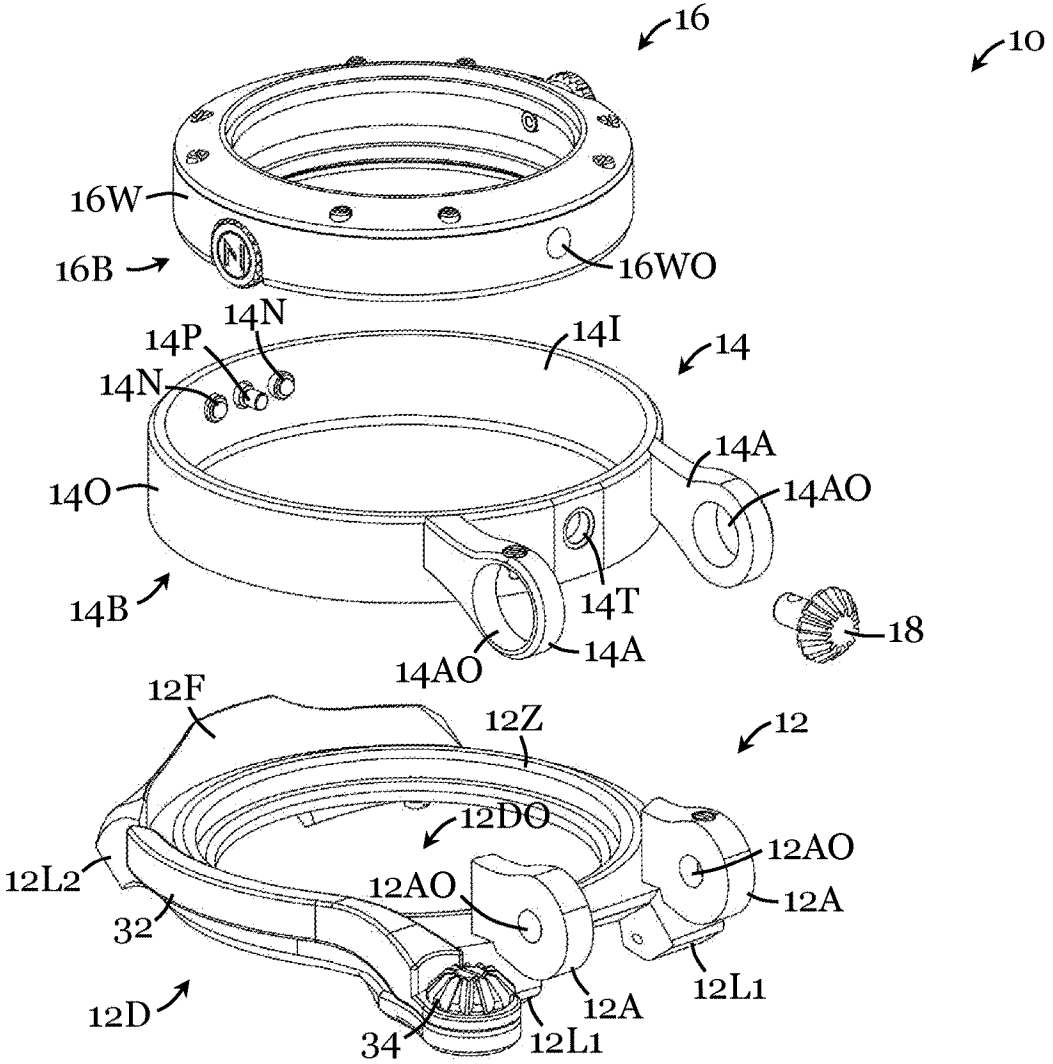
FIG. 3 is a part-exploded view illustrating the watch case of the watch of FIG. 1.
Figure 4:
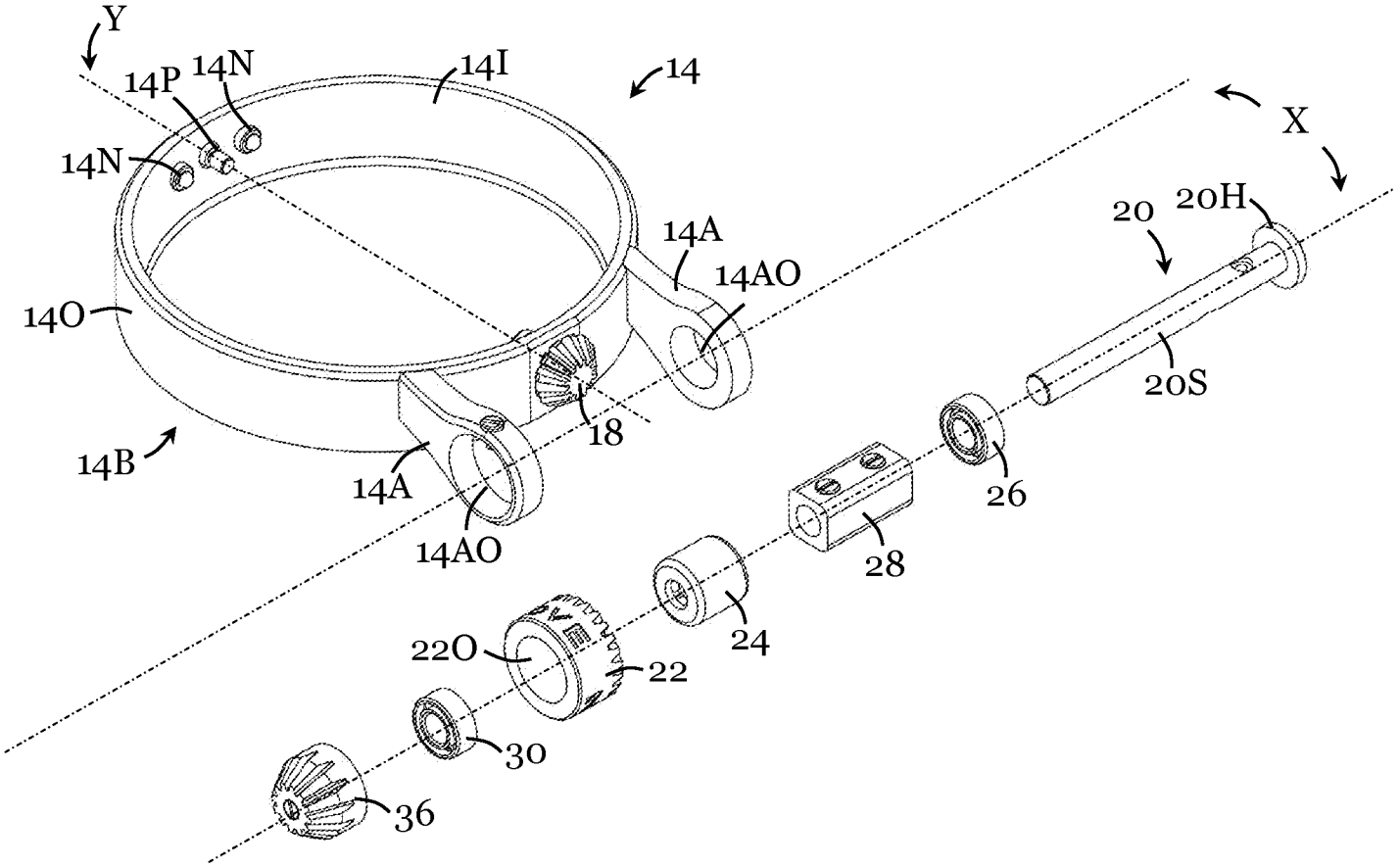
FIG. 4 is a part-exploded view illustrating the coupling mechanism of the watch of FIG. 1.

Referring to FIGS. 1, 3, and 5, the watch case 16 has a generally flat cylindrical body 16B configured to hold dials, movements, crowns, time display, electronics, etc., of the watch 10. The body 16B includes a first face 16F1, a second face 16F2 opposite the first face 16F1, and a generally annular wall 16W extending between the first and second faces 16F1, 16F2. A time display may be arranged on at least one of the first and second faces 16F1, 16F2. The first face 16F1 defines a first plane. The second face 16F2 defines a second plane arranged generally parallel to the first plane. The generally annular wall 16W extends generally perpendicular to the first and second planes. An opening 16WO is formed on the generally annular wall 16W. The opening 16WO is arranged to align with the through-hole 14T on the body 14B of the frame 14 when the watch case 16 is mounted to the frame 14. Another opening and two dimples (not shown) are arranged on an outer peripheral surface of the generally annular wall 16W at a position generally opposite the opening 16WO. The opening and dimples are arranged to correspond with the pin 14P and nubs 14N arranged on the radially inner surface 14I of the body 14B. The opening is configured to receive the pin 14P to support rotation of the watch case 16 about itself within the frame 14. The pin 14P and opening 16WO define a rotation axis Y of the watch case 16. The engagement between the nubs 14N and the corresponding dimples can prevent or reduce rotation of the watch case when the frame 14 is at the retracted position (either the first face or the second face is visible).

The watch case 16 is rotatable relative to the frame 14 about the rotation axis Y (or is rotatable about itself) to move between a first configuration, in which one of the first face 16F1 or the second face 16F2 is visible when the frame 14 is in the retracted position, and a second configuration, in which the other one of the first face 16F1 or the second face 16F2 is visible when the frame 14 is in the retracted position. In both configurations, the orientation of the watch case 16 is such that the generally annular wall 16W of the watch case 16 is arranged to face, and extend generally parallel to, the radially inner surface 14I of the body 14B of the frame 14. The frame 14 thus form a two-axis gimbal. The dimples of the watch case 16 are arranged to frictionally engage with the nubs 14N when the watch case 16 is at the first and second configurations. The frictional engagement helps to prevent rotation of the watch case 16 relative to the frame 14 and may provide an audible "click" sound when the nubs 14N and the dimples of the watch case 16 properly engage.

A watch case rotation gear 18, in the form of a bevel gear, is mounted through the through-hole 14T of the frame 14 and the aligned opening 16WO on the watch case 16. The watch case rotation gear 18 fixedly connects to the watch case 16 to facilitate rotation of the watch case 16. The watch case rotation gear 18 is arranged to rotate about the rotation axis Y along with the watch case 16.

A main shaft 20 with a head portion 20H and a shaft portion 20S is configured to extend through the openings 12AO of the arms of the base 12 to support components of the watch 10. A main shaft gear 22, in the form of a bevel gear, is rotatably supported on the shaft portion 20S. The main shaft gear 22 is arranged to abut a surface of one of the arms 12A of the base 12 and is arranged to mesh with the watch case rotation gear 18. The main shaft gear 22 includes an opening 22O in which a one-way roller clutch (e.g., one way bearing) 24 is mounted (e.g., by interference fit). The one-way roller clutch 24 is supported on or mounted to the shaft portion 20S. The one-way roller clutch 24 includes a rotary output member arranged around a coaxial rotary input member and enables rotation of the main shaft gear 22 in only one rotation direction. A bearing 26 and a generally cuboid position stopper 28 are arranged on the shaft portion 20S between the head portion 20H and the one-way roller clutch 24; another bearing 30 is arranged on the shaft portion 20S on another side of the one-way roller clutch 24. The bearings 26, 30 are ball bearings arranged to facilitate rotation of the components on the shaft portion 20S. The bearings 26, 30 are received at least partly in the openings 14AO of the arms 14A. The position stopper 28 is fixedly mounted to the main shaft 20 and is arranged to act as a spacer to keep the components, such as the bearings 24, 26, 30, in position. In this embodiment, the main shaft 20 elongates along the pivot axis X; the bearings 24, 26, 30, the position stopper 28, and the main shaft gear 22 are arranged co-axially along the pivot axis X, and between the arms 12A of the base 12 hence between the arms 14A of the frame 14. The arms 14A and their openings 14AO of the frame 14 are configured such that the pivot axis X is spaced sufficiently apart from the body 14B of the frame 14 to accommodate the watch case rotation gear 18 that extends generally orthogonal to the main shaft gear 22. In this embodiment, among other components, the watch case rotation gear 18, the main shaft gear 22, and the one-way roller clutch 24 form a coupling mechanism that operably couples the frame 14 and the watch case 16.

Referring to FIGS. 1, 2, and 5, the watch 10 also includes an actuation mechanism arranged to be manually operated to operate the coupling mechanism. The actuation mechanism includes an actuator in the form of a lever 32 coupled to the base 12 and a actuator gear arrangement in the form of a bevel gear pair to drivingly coupling the lever 32 with the frame 14 (and the coupling mechanism). The lever 32 is generally elongated (but not straight) and extends alongside the curved side 12C1 of the base 12 to generally follow its contour. An inner side wall of the lever 32 (the wall that directly faces the deck 12D) includes a groove 56 arranged to engage with (e.g., via friction fit, snap fit, etc.) the pin 55 arranged on the lever mount coupling portion 12HC when the lever 32 is unactuated (at the first position described below) to prevent unwanted actuation of the lever. The pin 55 and groove 56 are cooperating detent features for holding the lever 32 in a closed position and the frame 14 in the retracted position. An end of the lever 32 near the groove 56 includes a gear mount 32M on which a bevel gear 34 is fixedly mounted. The lever 32 with gear 34 is mounted to the lever mount 12H on the base 12. Another bevel gear 36 is fixedly received in the opening 14AO of the arm 14A of the frame 14 adjacent the lever mount 12H. That is, the bevel gear 36 is fixedly connected with the frame 14. The two bevel gears 34, 36 mesh with each other. The lever 32 is rotatable about a lever rotation axis Z to move between a first position that corresponds to the retracted position of the frame 14 and a second position that corresponds to the extended position of the frame 14. At the first position, the lever 32 abuts the curved side 12C1 of the base 12; at the second position the lever 32 is moved away from the base 12. The lever rotation axis Z is substantially orthogonal to the pivot axis X, and is substantially orthogonal to the rotation axis Y when the frame 14 is in the retracted position.

Figure 6:
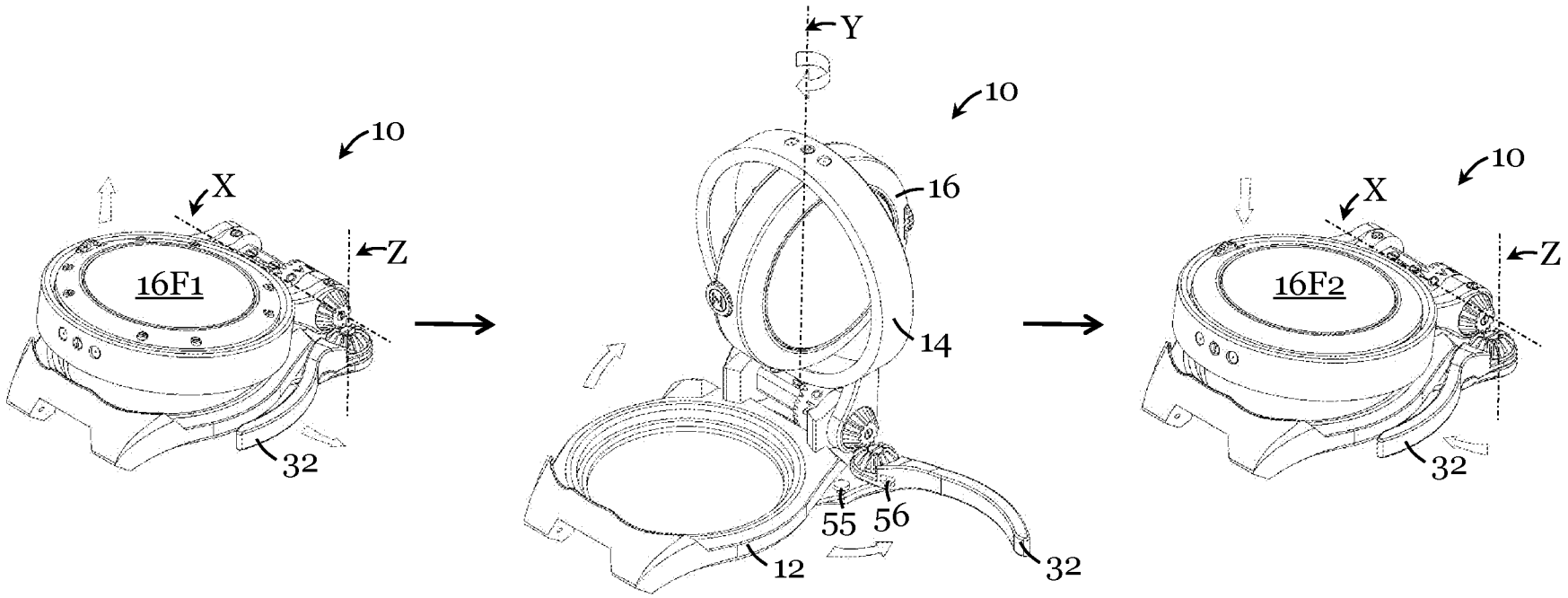
FIG. 6 is a schematic diagram showing the operation of the watch of FIG. 1.

FIG. 6 illustrate the operation of the watch 10 to flip over the watch case 16. Initially, the watch 10 is in the state as shown in FIG. 1, in which the frame 14 at a retracted position (in which the first face 16F1 is visible) and engages with the base 12 and the lever 32 is at the first position. To flip over the watch case 16, the user first rotates the lever 32 anti-clockwise about the lever rotation axis Z, to move the lever 32 from the first position towards the second position. The force applied by the user on or via the lever 32 is sufficient to releases the engagement between the pin 55 and the groove 56 and to overcome the frictional engagement (if any) between the flange 12F of the base 12 and the frame 14 as well as the frictional engagement (if any) between the nubs 14N of the frame 14 and the corresponding dimples of the watch case 16. The rotation of the lever 32 causes the bevel gear pair to operate and, as a result, the frame 14, which is fixedly connected with the bevel gear 36 of the bevel gear pair, gradually rises up to move from the retracted position towards the extended position. Meanwhile, as frame 14 moves towards the second position, the watch case rotation gear 18 rotates about axis Y and runs on the teeth of the main shaft gear 22. At this stage, the one-way roller clutch 24 (by virtue of the interaction of its rotary input and output members) prevents rotation the main shaft gear 22 such that the main shaft gear 22 generally does not rotate. The teeth of the watch case rotation gear 18 runs on the teeth of the main shaft gear 22 (which is prevented from rotation by the one-way roller clutch 24) and causes the watch case 16 to rotate about axis Y. When the lever 32 moves to the second position, which corresponds to the extended position of the frame 14, the watch case 16 is flipped by about 180 degrees (e.g., 135 degrees to 180 degrees), with the positions of the first and second faces 16F1, 16F2 generally reversed. Also, at the second position of the lever 32, which generally coincides with the extended position of the frame 14, the frame 14 has pivoted about axis X relative to the base by an angle of about 90 degrees to about 135 degrees and the lever 32 has been pivoted about axis Z by an angle of about 90 degrees to about 135 degrees. Now, the user begins to rotate the lever 32 from the second position towards the first position, to return the frame 14 to the retracted position. As the lever moves towards the first position, the frame 14 moves towards the retracted position. At this stage, the main shaft gear 22 is rotatable about axis X as the one-way roller clutch 24 (the interaction of its rotary input and output members) permits such rotation. The main shaft gear 22 rotates at generally the same rate as the bevel gear 36 to prevent rotation of the watch case rotation gear 18. As such, the watch case rotation gear 18 generally does not turn about axis Y as the frame 14 moves towards the retracted position. When the lever 32 moves back to the first position, at which the pin 55 and groove 56 re-engage, the frame 14 moves back to the retracted position to engage with the base 12, with the watch case 16 being flipped by 180 degrees, in which the second face 16F2 becomes visible. During this return, the force applied by the user on or via the lever 32 has to be sufficient to re-engage the pin 55 and the groove 56 (via friction fit, snap fit, etc.), move the flange 12F of the base 12 and the frame 14 back to frictional engagement (if any), and move the nubs 14N of the frame 14 and the corresponding dimples of the watch case 16 back to frictional engagement (if any). In this embodiment, the watch case 16 has been flipped by 180 degrees before the lever 32 moves back to the first position (see FIG. 6). In some embodiments, the 180 degrees flipping of the watch case 16 may be completed by engagement or contact of the watch case 16 with other structure(s) of the base 12 as they approach each other during the return. The same operation can be repeated to change between a first configuration, in which the first face 16F1 is visible when the frame 14 is at the retracted position, and a second configuration, in which the second face 16F2 is visible when the frame 14 is at the retracted position. The operation can be controlled relatively simply by the user, as the user only needs to pivot the lever about axis Y between the first and second positions to flip the watch case.

It will be appreciated by persons skilled in the art that numerous variations and/or modifications may be made to the illustrated embodiments to provide other embodiments of the invention. The illustrated embodiments of the invention should be considered in all respects as illustrative, not restrictive.

For example, the timepiece need not be in the form of a watch and need not be portable or wearable. The shape, size, dimension, etc., of the timepiece (the base, the frame, the watch case, etc.) can be different from those illustrated. The opening of the deck of the base may be replaced with a generally flat wall that faces a backside of the watch case, optionally with a gap there-between. The lever may be replaced with or combined with other types of actuators. The timepiece can be mechanical, electric, digital, or the like, with at least one face that has a time display (any form). The coupling mechanism may be constructed differently, with more gears or fewer gears, alternative gear means, bearing means, etc. The term "gears" may encompass toothed and un-toothed wheels. The coupling mechanism may be configured differently to operably couple the pivoting movement of the frame relative to the base and the rotation of the watch case relative to the frame. For example, the coupling mechanism may rotate watch case relative to the frame by less than 180 degrees (e.g., simply to move the watch case out of the frame from the first configuration to facilitate subsequent user manipulation of the watch case) or by more than 180 degrees (e.g., by odd multiples of 180 degrees, e.g., 180 degrees, 540 degrees, etc.). The coupling mechanism may selectively rotate the watch case relative to the frame during any part(s) of the pivoting cycle of the frame. The actuation assembly may be modified or omitted (e.g., the user directly holds and pivots the frame). Additional or less bearings, washers, etc., may be used. The watch case can be but need not be water resistant. The two axes of the two axis gimbal provided by the frame can be at different angles (e.g., substantially perpendicular or orthogonal).

In some applications, the timepiece may be modified to be other articles, such as photo-frame, jewelry, by replacing the watch case with a corresponding element or assembly suited for the application.

The invention claimed is:

1. A timepiece comprising:

a base;

a case holding a time display;

a frame to which the case is pivotably connected for rotation about a first axis, the frame pivotably connected to the base for rotation about a second axis between an extended and a retracted position, the frame forming a two-axis gimbal supporting the case; and a gimbal coupling mechanism operably coupling the frame and the case whereby rotation of the frame from the retracted position to the extended position then back to the retracted position rotates the case about the first axis to facilitate flipping of the case so as to selectively hide or show the time display.

2. The timepiece of claim 1, wherein the gimbal coupling mechanism operably couples the frame and the case whereby rotation of the frame toward the extended position rotates the case about the first axis, and rotation of the frame toward the retracted position prevents rotation of the case about the first axis.

3. The timepiece of claim 1, wherein the gimbal coupling mechanism comprises:

a gimbal gear pair comprising a first gear mounted to the case and a second gear mounted to the base or the frame; and a one-way clutch having a rotary output member fixed to the first gear or the second gear for unidirectional rotation.

4. The timepiece of claim 3, wherein the first and second gears comprise meshed toothed wheels.

5. The timepiece of claim 3, wherein the first gear is rotationally fast with the case and rotates about the first axis and the second gear is mounted for rotation about the second axis.

6. The timepiece of claim 3, wherein the rotary output member surrounds a coaxial rotary input member and is fixed at least partially within the second gear.

7. The timepiece of claim 1, wherein the timepiece further comprises an actuator coupled to the base to rotate the frame between the extended and retracted positions.

8. The timepiece of claim 7, wherein the actuator comprises a lever that is arranged to be manually operated.

9. The timepiece of claim 8, wherein the lever rotates an actuator gear pair comprising a first actuator gear connected to the lever to turn about a fulcrum axis and a second actuator gear rotationally fast with the frame and mounted to rotate about the second axis.

10. The timepiece of claim 9, wherein the first and second actuator gears comprise meshed toothed wheels.

11. The timepiece of claim 9, wherein the fulcrum axis is substantially orthogonal to each of the first and second axes when the frame is at the retracted position.

12. The timepiece of claim 9, wherein the lever and the base comprise cooperating detent features for holding the lever in a closed position and the frame in the retracted position.

13. The timepiece of claim 12, wherein the lever extends alongside an edge of the base in the closed position.

14. The timepiece of claim 1, wherein the timepiece is a wristwatch.

* * * * *